United States Patent [19]

Saito et al.

[11] 4,131,450

[45] Dec. 26, 1978

[54] PROCESS FOR MANUFACTURING COBALT-BASE REDUCED POWDER

[75] Inventors: Yuichi Saito; Masayuki Iijima; Osamu Mayama, all of Niigata, Japan

[73] Assignee: Mitsubishi Kinzoku Kabushiki Kaisha, Tokyo, Japan

[21] Appl. No.: 876,274

[22] Filed: Feb. 9, 1978

Related U.S. Application Data

[63] Continuation-in-part of Ser. No. 765,433, Feb. 4, 1977, abandoned.

[51] Int. Cl.[2] ..... B22F 9/00; C22C 19/08

[52] U.S. Cl. ..... 75/0.5 BA; 75/0.5 BB; 75/171; 75/246

[58] Field of Search ..... 75/0.5 B, 0.5 BA, 0.5 BB, 75/171, 84, 236, 239, 240, 241, 242, 245, 246, 247, 211, 213

[56] References Cited

U.S. PATENT DOCUMENTS

| | | | |
|---|---|---|---|
| 2,091,017 | 8/1937 | Schwarzkopf | 75/240 |
| 2,160,670 | 5/1934 | Oswald | 75/213 |
| 2,853,767 | 9/1958 | Burkhammer | 75/211 |
| 2,854,327 | 9/1958 | Perring et al. | 75/84 |
| 3,488,291 | 1/1970 | Hardy et al. | 75/211 |
| 3,510,292 | 5/1970 | Hardy et al. | 75/211 |
| 4,047,982 | 9/1977 | Sagawa et al. | 75/84 |

FOREIGN PATENT DOCUMENTS

| | | | |
|---|---|---|---|
| 2153626 | 5/1972 | Fed. Rep. of Germany | 75/0.5 BB |
| 45-5372 | 6/1965 | Japan | 75/211 |

*Primary Examiner*—R. Dean
*Assistant Examiner*—Michael L. Lewis
*Attorney, Agent, or Firm*—Flynn & Frishauf

[57] ABSTRACT

A main raw material powder comprising cobalt oxide powder, chromium oxide powder and carbon powder is added with at least one metal oxide powder selected from the group consisting of manganese oxide powder, vanadium oxide powder, titanium oxide powder, tantalum oxide powder, niobium oxide powder, boron oxide powder, hafnium oxide powder, tungsten oxide powder, molybdenum oxide powder, iron oxide powder, nickel oxide powder and copper oxide powder; these powders are then mixed and pulverized to prepare a mixed powder; said mixed powder is then reduced by heating under vacuum or in a reducing atmosphere to obtain a reduced sponge-like mass; said sponge-like mass is finely pulverized, thereby manufacturing a cobalt-base reduced powder.

A cobalt-base sintered alloy, produced by using said cobalt-base reduced powder thus manufactured as the material powder, has a relatively wide range of diffusion sintering temperatures applicable at the time of sintering thereof and has furthermore a high sintered density.

4 Claims, No Drawings

PROCESS FOR MANUFACTURING COBALT-BASE REDUCED POWDER

RELATED APPLICATION

This application is a continuation-in-part of application Ser. No. 765,433 filed Feb. 4, 1977, now abandoned.

FIELD OF THE INVENTION

The present invention relates to a process for manufacturing a cobalt-base reduced powder containing cobalt as the main constituent element as well as chromium and at least one metal element selected from the group consisting of manganese, vanadium, titanium, tantalum, niobium, boron, hafnium, tungsten, molybdenum, iron, nickel and copper.

BACKGROUND OF THE INVENTION

Cobalt-base cast alloys containing such elements as chromium, manganese, vanadium, titanium, tantalum, niobium, boron, hafnium, tungsten, molybdenum, iron, nickel, copper and carbon have generally heat resistance, wear resistance and corrosion resistance superior to those of high-alloy steels, and are therefore popularly in practical use as materials for structural members serving under serious conditions.

In the above-mentioned conventional cobalt-base cast alloys, however, crystal grains of cobalt forming the base grow into coarse dendrites at the time of casting, solidification and cooling thereof. It is also inevitable at the same time that chromium, tungsten and other constituent elements react with carbon, another constituent element, to form carbides which also grow into coarse grains. In addition, as compared with high-alloy steels, the conventional cobalt-base cast alloys are far inferior in the plastic formability in hot and cold. It is therefore very difficult to refine the above-mentioned base crystal grains and carbide grains thus becoming coarse by forging the alloys.

Because of the aforementioned coarse base crystal grains and carbide grains, in putting the conventional cobalt-base cast alloys to practical use, local stress concentration occurring in said coarsening portions often causes breakout of the cast alloys, and moreover, segregation of the constituent elements causes such problems as the decrease in the corrosion resistance of the cast alloys. It is also very difficult to machine the conventional cobalt-base cast alloys into structural members of desired shape and dimensions at a high accuracy because of the very low machinability of such alloys.

With a view to solving the above-mentioned problems inherent to the conventional cobalt-base cast alloys, there is proposed the manufacture of cobalt-base sintered alloys having substantially the same chemical compositions as the cobalt-base cast alloys by the powder metallurgy process.

The known processes now in industrial use for the manufacture of a material powder to be used in the production of the above-mentioned cobalt-base sintered alloy include the electrolytic process, the atomizing process, the milling process and the reducing process.

From among the aforementioned processes for manufacturing a material powder, the electrolytic process is not suitable for the manufacture of an alloy powder, because it is only applicable for the manufacture of a pure metal powder, whereas the atomizing process, the milling process and the reducing process are all suitable for the production of a metal powder or an alloy powder.

However, the alloy powder serving as the material powder manufactured by the conventional atomizing process has not only a spherical shape but also a relatively large particle size, this leading to a low compression-formability. What is worse, in sintering, particle surfaces of said alloy powder are not mutually diffused even by heating said alloy powder to a temperature near the melting point thereof. It is therefore difficult to impart to thus manufactured sintered alloy required properties, especially a high sintered density. Furthermore, the too tight range of sintering temperatures for said alloy powder makes it difficult to apply an effective control over the sintering temperature and hence to go into mass production of sintered alloy.

In the case of the alloy powder produced by the conventional milling process, it is difficult to control the grain size thereof, and inclusion of impurities is inevitable. Furthermore, since said alloy powder is seriously work-hardened by milling, it is necessary to relieve internal stress by the heat-treatment known as normalization prior to its use as the material powder for a sintered alloy.

Although the conventional reducing process is practicable for the production of a metal powder or an alloy powder from relatively easily reducible metal oxide powders, it is very difficult with the conventional reducing process to produce an alloy powder containing such difficultly reducible metal elements as chromium, manganese, vanadium, titanium, tantalum, niobium, boron and hafnium.

Furthremore, the manufacture by the conventional reducing process of alloy powders containing both difficultly reducible metal elements such as chromium, manganese, vanadium, titanium, tantalum, niobium, boron and hafnium and relatively easily reducible metal elements such as cobalt, tungsten, molybdenum, iron, nickel and copper poses the following problems:

(1) Oxide powders of relatively easily reducible metal elements such as cobalt, tungsten, molybdenum, iron, nickel and copper can be easily reduced in a hydrogen atmosphere by heating to a relatively low temperature, whereas oxide powders of difficultly reducible metal elements such as chromium, manganese, vanadium, titanium, tantalum, niobium, boron and hafnium are hardly reduced under the same conditions.

(2) On the other hand, at high temperatures, at which oxide powders of difficultly reducible metal elements such as chromium, manganese, vanadium, titanium, tantalum, niobium, boron and hafnium can be reduced, oxide powders of relatively easily reducible metal elements such as cobalt, tungsten, molybdenum, iron, nickel and copper are naturally reduced, but also, these powders are mutually diffused and sintered, and as a result, become lumpy, thus making it very difficult to recover in the powdery form.

Because of these problems, the conventional reducing process cannot be suitable for the manufacture of an alloy powder containing both relatively easily reducible and difficultly reducible metal constituents.

SUMMARY OF THE INVENTION

A principal object of the present invention is therefore to provide a process for manufacturing a cobalt-base reduced powder containing at least one difficultly reducible metal element and if necessary also containing at least one relatively easily reducible metal element.

Another object of the present invention is to provide a process for manufacturing a cobalt-base reduced powder using as the main constituent element a mixed powder comprising cobalt oxide powder, chromium oxide powder and carbon powder, said mixed powder being able to be reduced at reducing temperatures much lower than those conventionally applied.

Still another object of the present invention is to provide a process for manufacturing a cobalt-base reduced powder suitable for use as a material powder for the production of a cobalt-base sintered alloy having a relatively wide range of diffusion sintering temperatures applicable at the time of sintering thereof and a high sintered density.

A further object of the present invention is to provide a process for manufacturing a cobalt-base reduced powder comprising very fine and homogeneous particles.

In accordance with one of the features of the Present invention, there is provided a method for manufacturing a cobalt-base reduced powder which comprises:

adding, to a main raw material powder comprising cobalt oxide powder, chromium oxide powder and carbon powder, at least one metal oxide powder selected from the group consisting of manganese oxide powder, vanadium oxide powder, titanium oxide powder, tantalum oxide powder, niobium oxide powder, boron oxide powder, hafnium oxide powder, tungsten oxide powder, molybdenum oxide powder, iron oxide powder, nickel oxide powder and copper oxide powder;

mixing and pulverizing these powders to prepare a mixed powder;

reducing said mixed powder by heating under vacuum or in a reducing atmosphere to obtain a reduced sponge-like mass; and finely pulverizing said reduced sponge-like mass.

DETAILED DESCRIPTION OF PREFERRED EMBODIMENTS

In view of the foregoing, we have made intensive studies to solve the above-mentioned drawbacks in the conventional processes for manufacturing a material powder used for the manufacture of a cobalt-base sintered alloy. As a result, it has been found that a cobalt-base reduced powder comprising very fine and homogeneous particles can be manufactured by adding, to a main raw material powder comprising cobalt oxide powder, chromium oxide powder and carbon powder, at least one metal oxide powder selected from the group consisting of manganese oxide powder, vanadium oxide powder, titanium oxide powder, tantalum oxide powder, niobium oxide powder, boron oxide powder, hafnium oxide powder, tungsten oxide powder, molybdenum oxide powder, iron oxide powder, nickel oxide powder and copper oxide powder; mixing and pulverizing these powders to prepare a mixed powder; reducing said mixed powder by heating under vacuum or in a reducing atmosphere to obtain a reduced sponge-like mass; and finely pulverizing said reduced sponge-like mass, and also that the cobalt-base sintered alloy produced from thus manufactured cobalt-base reduced powder as the material powder has a relatively wide range of diffusion sintering temperatures applicable at the time of sintering thereof and a high sintered density.

Oxide powders of the aforementioned constituent metals used as the starting material powder in the process of the present invention are very easily pulverized into fine powders because of the lack of toughness as compared with metal powders or alloy powders. Also as compared with mixed powders of pure metals, there are only slightest differences in shape and specific gravity between metals as to said oxide powders of constituent metals, and it is possible to prepare a mixed powder by very uniformly mixing these oxide powders.

In the process of the present invention, furthermore, in reducing said mixed powder comprising said oxide powders of constituent metals by heating, cobalt oxide powder, iron oxide powder and nickel oxide powder are easily reduced, and moreover, the produced carbon monoxide reduces tungsten oxide powder, molybdenum oxide powder and chromium oxide powder, part of which becoming carbides. Reduction of difficultly reducible metal oxide powders such as chromium oxide powder, manganese oxide powder, vanadium oxide powder and titanium oxide powder proceeds in the presence of carbon powder added and mixed at the same time.

In the process of the present invention oxide powders of constituent metals used as the starting material powders have a very fine particle size as described above. The reduction and carbonization reactions of these constituent metals are therefore completed in a relatively short period of time. The process of the present invention is thus industrially applicable to the full.

Further, we have found that if a powder of a $Me_2O_3$—type oxide (Me represents a difficultly reducible metal) as represented by chromium oxide is mixed with a powder of a ferrous metal oxide as represented by cobalt oxide and the resulting mixed powder is subjected to reduction, said oxide powders react with each other due to heating in the reduction step to form a double oxide, e. g., $CoCr_2O_4$ and a powder of such double oxide can be easily reduced at reducing temperatures far lower than those required for reducing chromium oxide powder alone.

More specifically, chromium oxide alone cannot be reduced in a reducing atmosphere having a dew point of −20° C. unless heated to 1200° C. or more. However, if chromium oxide is subjected to reduction together with a ferrous metal oxide such as cobalt oxide, chromium oxide reacts with said ferrous metal oxide by heating for reduction to form a double oxide such as $CoCr_2O_4$. Such double oxide can be reduced even at a reducing temperature in a reducing atmosphere having a dew point of −20° C. Whilst, if it is desired to reduce chromium oxide alone at a reducing temperature of 700° C., a reducing atmosphere having a dew point of −70° C. is necessary, thus rendering difficult the production on an industrial scale. On the other hand, in the case of reducing chromium oxide alone at a reducing temperature of 1200° C. or higher in a reducing atmosphere having a dew point of −20° C., the reducing temperature is so close to the sintering temperature of 1,250° C. of chromium oxide that strict control of the reducing temperature will be necessary so as to prevent the powder of chromium oxide from becoming sintered during the reduction step.

As described above, a reducing temperature of 700° C. is applicable to the process of the present invention. However, with such low reducing temperature a very long period of time is required for sufficient reduction, which is inappropriate for working of our process on an industrial scale. In usual operation are therefore applied reducing conditions comprising a reducing temperature of 1,000–1,150° C. and 0.5–5 hours in a reducing atmosphere (gaseous hydrogen flow) having a dew point of −20° C.

The cobalt-base reduced powder manufactured in accordance with the present invention therefore comprises metal carbide powders produced through carbonation of metal oxides, metal powders produced through reduction of metal oxides and alloy powders produced through reaction between metal oxides into double oxides and subsequent reduction of said double oxides. From the microscopic point of view, the cobalt-base reduced powder of the present invention, which has been reduced at so low a reducing temperature as mentioned above, is a secondary powder formed by a slight mutual agglomeration between particles of powders of said constituent elements and powders of carbides thereof, which are primary powder. In this state, particle surfaces of powders of said constituents and powders of carbides thereof are not as yet sufficiently mutually diffused due to such low reducing temperature, that is, said cobalt-base reduced powder which is the secondary powder is not as yet completely alloyed. Said cobalt-base reduced powder has therefore a sponge-like structure comprising groups of the primary powder and presents complicated and irregular shapes. This results in a very high compression-formability of said cobalt-base reduced powder, in spite of the very fine particle size thereof, permitting easy forming by the dieforming process. Furtheremore, this very fine particle size enables the manufactures of a sintered alloy having a high sintered density.

Now, the process of the present invention is described more in detail by way of an example.

EXAMPLE 1

A mixed powder consisting of 700 g of cobalt oxide (II) (CoO) powder, 227 g of chromium oxide (III) ($Cr_2O_3$) powder, 152 g of tungsten oxide (VI) ($WO_3$) powder and 86 g of carbon (C) powder, having a particle size of up to 100 mesh, respectively, was pulverized by a ball mill for 24 hours to prepare a fine mixed powder having an average particle size of 1.5 μm.

Then, said fine mixed powder was reduced by heating to 1,150° C. and holding at this temperature for 2 hours in a gaseous hydrogen flow of a dew point of −40° C. to obtain a reduced sponge-like mass consisting essentially of, in weight percentage:

| | |
|---|---|
| chromium | 31.0% |
| tungsten | 12.0% |
| carbon | 2.5% |

and the balance cobalt and incidental impurities.

Said reduced sponge-like mass could easily be pulverized by a hammer mill to a size of up to 100 mesh thus permitting manufacture of a cobalt-base reduced powder of the process of the present invention.

The cobalt-base reduced powder of the process of the present invention thus obtained had a sponge-like structure and an irregular exterior shape, and showed substantially the same chemical composition as that of said reduced sponge-like mass. Properties of said cobalt-base reduced powder are indicated in Table 1. For comparison purposes, properties of another cobalt-base alloy powder, having substantially the same chemical composition as that of said cobalt-base reduced powder, manufactured by the conventional atomizing process outside the scope of the present invention are also shown in Table 1.

Table 1

| | Apparent density (g/cm³) | Apparent particle size distribution (wt. %) 100 to over 250 mesh | 250 to over 325 mesh | up to 325 mesh | Primary powder particle size (μm) |
|---|---|---|---|---|---|
| Co-base reduced powder manufactured by the process of the present invention | 3.78 | 24 | 11 | 65 | 5.6 |
| Co-base alloy powder manufactured by the conventional atomizing process | 4.03 | 56 | 19 | 26 | at least 50 |

As shown in Table 1, the particle size of the cobalt-base reduced powder manufactured by the process of the present invention is very fine as compared with that of the alloy powder manufactured by the conventional atomizing process.

Then, with said cobalt-base reduced powder manufactured by the process of the present invention and said cobalt-base alloy powder manufactured by the conventional atomizing process as the material powders, respectively, two kinds of green compact were formed from said material powders under a pressure of 6 tons/cm². This was followed by the sintering of said green compacts at a room temperature of 1,230° C. for 1 hour under vacuum, to manufacture two kinds of cobalt-base sintered alloy.

The green densities and the sintered densities of these two cobalt-base sintered alloys thus manufactured are indicated in Table 2.

Table 2

| | Green density (g/cm³) | Sintered density (g/cm³) |
|---|---|---|
| Co-base sintered alloy produced from Co-base reduced powder manufactured by the process of the present invention | 5.6 | 8.2 |
| Co-base sintered alloy produced from Co-base alloy powder manufactured by the conventional atomizing process | 5.8 | 6.0 |

As shown in Table 2, while the green density of the green compact produced from the cobalt-base reduced powder manufactured by the process of the present invention is slightly lower than that of the green compact produced from the cobalt-base alloy powder manufactured by the conventional atomizing process, the sintered density of the former is far higher than that of the latter.

EXAMPLE 2

A fine mixed powder which is the same as that prepared in EXAMPLE 1 was reduced by heating to 1,050° C. and holding at this temperature for 5 hours in a gaseous hydrogen flow of a dew point of −40° C. to obtain a reduced sponge-like mass consisting essentially of, in weight percentage:

| | |
|---|---|
| chromium | 31.0% |

-continued

| | |
|---|---|
| tungsten | 12.0% |
| carbon | 2.5% |

and the balance cobalt and incidental impurities.

Said reduced sponge-like mass could easily be pulverized by a hammer mill to a size of up to 100 mesh, thus permitting manufacture of a cobalt-base reduced powder of the process of the present invention.

The cobalt-base reduced powder of the process of the present invention thus obtained had a sponge-like structure and an irregular exterior shape, and showed substantially the same chemical composition as that of said reduced sponge-like mass. Properties of said cobalt-base reduced powder are indicated in Table 3 together with properties of another cobalt-base alloy powder, having substantially the same chemical composition as that of said cobalt-base reduced powder, manufactured by the conventional atomizing process outside the scope of the present invention for comparison purposes:

Table 3

| | Apparent density ($g/cm^3$) | Apparent particle size distribution (wt. %) 100 to over 250 mesh | 250 to over 325 mesh | up to 325 mesh | Primary powder particle size ($\mu m$) |
|---|---|---|---|---|---|
| Co-base reduced powder manufactured by the process of the present invention | 3.56 | 17 | 8 | 75 | 4.3 |
| Co-base alloy powder manufactured by the conventional atomizing process | 4.03 | 56 | 19 | 26 | at least 50 |

Then, with said cobalt-base reduced powder manufactured by the process of the present invention and said cobalt-base alloy powder manufactured by the conventional atomizing process as the material powders, respectively, two kinds of cobalt-base sintered alloys were manufactured under the same conditions as in EXAMPLE 1.

The green densities and the sintered densities of these two cobalt-base sintered alloys thus manufactured were found exactly the same as those shown in Table 2 of EXAMPLE 1.

According to the present invention, as described above in detail, it is possible to manufacture, through simple manufacturing processes and at a low cost, a fine and homogeneous cobalt-base reduced powder containing difficultly reducible metal elements, and if necessary, containing also relatively easily reducible metal elements. By using said cobalt-base reduced powder as the material powder, furthermore, it is possible to manufacture a cobalt-base sintered alloy having a relatively wide range of diffusion sintering temperatures applicable at the time of sintering thereof and a high sintered density. In addition, said cobalt-base reduced powder is applicable as a welding powder and a building-up powder, thus providing industrially useful effects.

What is claimed is:

1. A process for manufacturing a cobalt-base reduced powder which comprises:

adding, to a main raw material powder comprising cobalt oxide powder, chromium oxide powder and carbon powder, at least one metal oxide powder selected from the group consisting of manganese oxide powder, vanadium oxide powder, titanium oxide powder, tantalum oxide powder, niobium oxide powder, boron oxide powder, hafnium oxide powder, tungsten oxide powder, molybdenum oxide powder, iron oxide powder, nickel oxide powder and copper oxide powder;

mixing and pulverizing these powders to prepare a mixed powder;

reducing said mixed powder by heating to obtain a reduced sponge-like mass; and finely pulverizing said reduced sponge-like mass.

2. The process as claimed in claim 1, wherein said mixed powder is reduced by heating under vacuum.

3. The process as claimed in claim 1, wherein said mixed powder is reduced by heating in a hydrogen atmosphere.

4. The process as claimed in claim 1, wherein said mixed powder is reduced by heating at a temperature of 700–1,150° C. in a reducing atmosphere of a dew point of −20° C.

* * * * *